United States Patent [19]

Capo-Bianco

[11] Patent Number: 4,936,228

[45] Date of Patent: Jun. 26, 1990

[54] MODULAR OFFICE WORKSTATION

[76] Inventor: Anthony Capo-Bianco, Clock House, Cowfold, Horsham, West Sussex, RH13 8DF, England

[21] Appl. No.: 257,536

[22] Filed: Oct. 14, 1988

[30] Foreign Application Priority Data

Oct. 16, 1987 [GB] United Kingdom ..... 8724326

[51] Int. Cl.[5] ..... A47B 47/00

[52] U.S. Cl. ..... 108/64; 312/196

[58] Field of Search ..... 108/64, 60, 66, 50, 108/150; 211/184; 312/107, 196, 195, 198, 278

[56] References Cited

U.S. PATENT DOCUMENTS

| | | | |
|---|---|---|---|
| 2,658,810 | 11/1953 | Ellis et al. | 312/238 |
| 3,160,451 | 12/1964 | Lewis | 312/196 |
| 3,342,147 | 9/1967 | Shettles | 108/64 |
| 3,931,771 | 1/1976 | Kramer | 312/196 X |
| 4,503,781 | 3/1985 | Nilsson | 108/64 |
| 4,625,471 | 12/1986 | Cheng | 108/60 X |
| 4,700,572 | 11/1987 | Priesemuth | 108/60 |

FOREIGN PATENT DOCUMENTS

| | | | |
|---|---|---|---|
| 2615234 | 10/1977 | Fed. Rep. of Germany . | |
| 2646962 | 4/1978 | Fed. Rep. of Germany . | |
| 3542892 | 6/1987 | Fed. Rep. of Germany . | |
| 690918 | 6/1965 | Italy | 108/64 |

*Primary Examiner*—Jose V. Chen

*Attorney, Agent, or Firm*—Sherman and Shalloway

[57] ABSTRACT

Furniture suitable for use in offices and the like. A workstation comprises a worksurface having a constant radius front edge, first and second end edges extending from the front edge substantially at right angles to each other, first and second support members fixedly secured to the worksurface in the vicinity of the first and second end edges respectively and at least one further support member fixedly secured at a further edge of the worksurface.

11 Claims, 3 Drawing Sheets

MODULAR OFFICE WORKSTATION

FIELD OF THE INVENTION

This invention relates to furniture suitable for use in offices and the like.

BACKGROUND OF THE DISCLOSURE

Traditionally offices have been equipped, inter alia, with separate, stand-alone desks but in recent years the need for greater efficiency and communication, particularly in open-plan offices, has seen the introduction of so-called "workstations". Such a workstation can provide a relatively large work surface with ample space to receive typewriters, computers or visual display units (V.D.U.s) their keyboards and the like.

In addition, a need has been perceived for additional visual and aural privacy. Consequently, portable screens of sound-absorbing material can be provided and arranged around desks and workstations to provide some measure of privacy.

SUMMARY OF THE INVENTION

According to the invention there is provided a workstation comprising a worksurface having a preferably constant radius front edge, first and second end edges extending from the front edge substantially at right angles to each other, first and second support members fixedly secured to the worksurface in the vicinity of the first and second end edges respectively and at least one further support member fixedly secured at a further edge of the worksurface.

The worksurface may comprise first and second side edges extending from the first and second end edges respectively, substantially at right angles to the end edges and to each other and in converging directions.

The side edges may be truncated and interconnected by a rear edge to provide a cut-away or recessed rear corner. This facilitates the placing of the workstation against an obstruction such as a structural column, the positioning of four such workstations in a star-shaped configuration around such a construction and so on.

First and second said further support members may be provided of substantially L-shaped or right-angled cross section configuration fixedly secured to the worksurfaces in the vicinity of the junctions of the first side edge with the rear edge and the second side edge with the rear edge respectively. By the use of such further support members voids are left between the worksurface and the support members through which electrical cables and the like can be passed.

Connection means can be connected between the said two further support members to provide additional stability to the structure.

The connection means may be a cupboard.

BRIEF DESCRIPTION OF DRAWINGS

The invention will now be described by way of example with reference to the accompanying drawings, in which.

DETAILED DESCRIPTION OF PREFERRED EMBODIMENT

Figure 1:
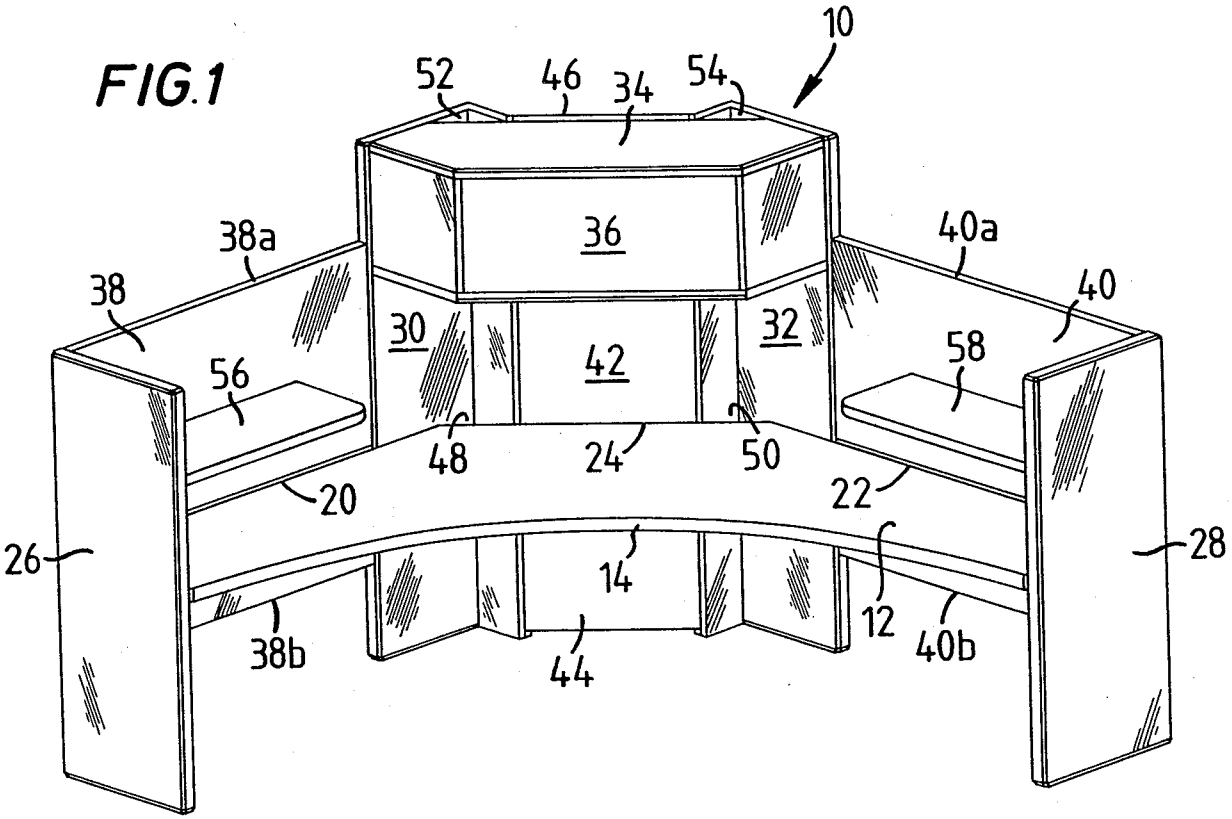
FIG. 1 shows a perspective view of one embodiment of a workstation according to the invention.
Figure 2:
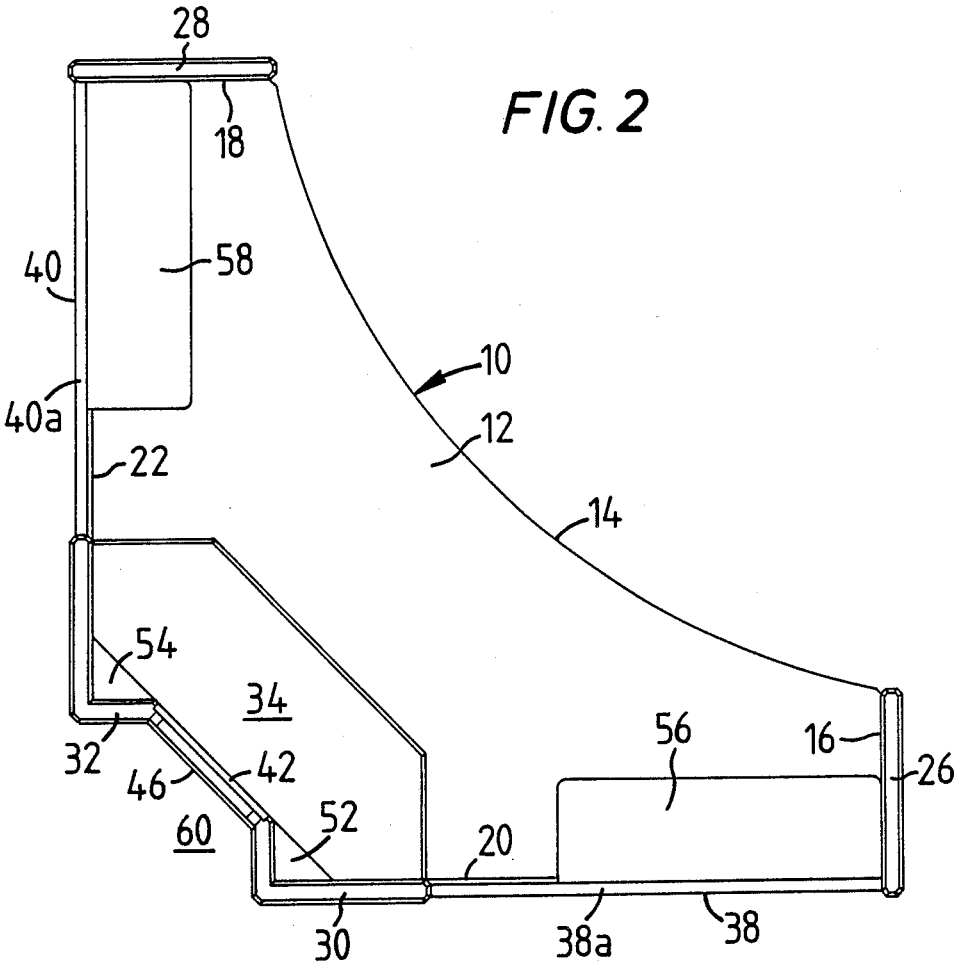
FIG. 2. is plan view of the workstation taken above the worksurface.

Referring to the drawings, there is shown a workstation 10 comprising a single-piece worksurface 12 having a front edge 14 which describes a substantially constant, inwardly directed radius curve over its full length, two end edges 16, 18 extending substantially at right angles to each other, two side edges 20, 22 extending from the end edges 16, 18 respectively substantially at right angles to their respective end edges and to each other so that they converge but do not meet, being truncated by a rear edge 24.

The worksurface 12 is supported by first and second end support panels 26, 28 fixedly secured to the end edges 16, 18 respectively and first and second substantially L-shaped support panels 30, 32 fixedly secured to the side edges 20, 22 respectively at their junctions with the rear edge 24. These panels may be fixedly secured to the worksurface in any suitable way, for example by means of softwood blocks (not shown) which are secured to the undersurface of the worksurface and bolted to a respective support panel.

The panels 26, 28, 30, 32 not only support the worksurfaces and play their part in maintaining the rigidity of the structure but also provide some privacy screening for the user of the workstation.

The panels 26, 28, 30, 32 can be provided on their lower edge surfaces with adjustable feet or the like (not shown) to facilitate levelling of the workstation on uneven floors.

A cupboard 34 is fixedly secured, as by bolts (not shown), to the support panels 30, 32 and provides added stability to the structure. It can be provided with an up-and-over door 36 which runs the full width of the central face of the cupboard. The cupboard is of sufficient height above the worksurface 12 to allow a V.D.U. and drive unit to be located underneath. The internal height of the cupboard is sufficient to allow office files to be accommodated in an upright position.

Fixedly secured between the support panels 26, 30 and 28, 32 are further panels 38 and 40 respectively which can also be attached to the worksurface 14 in the vicinity of its side edges 20, 22 respectively. The panels 38 and 40 also add to the stability of the structure and provide privacy screening.

The panels 38, 40 terminate at their upper edges **38*a*, 40*a* at about the same level as panels 26, 28, the height being such that a seated person at the workstation is screened, but a standing person can see over them. The panels 38, 40 terminate at their lower edges 38*b*, 40*b* at a level between the undersurface of the worksurface 12 and the floor. This is to provide for an adequate free flow of air around the workstation 10**.

Removably secured between the panels 30, 32, the worksurface 12, and cupboard 36 is a panel 42. This panel 42 allows cables and the like to pass under it to the space behind and can accommodate various electric socket outlets.

Removably secured between panels 30, 32 and below the worksurface 12 is a further panel 44. This panel 44 also allows access to the space behind the workstation and can accommodate various socket outlets.

When the workstation 10 is positioned so that the rear can be seen a further removable panel 46 can be mounted on panels 30, 32 in spaced parallel relation to the panels 42, 44 to form a cavity therebetween to accommodate cables and the like.

The triangular voids 48, 50 between the worksurface and panels 30, 32 facilitate the provision of services such as cables and the like to pass above and below the worksurface.

Similar voids 52, 54 are provided between panels 30, 32 and the cupboard 34.

Two shelves 56, 58 are each mounted as shown by means of two metal dowels (not shown) fixed to protrude from the panels 26, 28 respectively and into an end of the corresponding shelf, and a metal support bar (not shown) which extends from the associated panels 38, 40 to support the other end of the shelf.

The panels will generally be of solid construction and chipboard with a decorative timber veneer face and matching hard wood lippings. Alternatively the panels can be constructed by utilising framing of wood, metal, or plastics with an infill of similar or contrasting material.

The rear screen panels 38, 40 should be constructed to allow a degree of acoustic absorbtion and be able to receive pins for use as a pin board although, of course, these features are not essential to the invention.

Two such workstations can be arranged side by side and it will be realised that a plurality could be arranged in line. A further plurality could be arranged in line back to back with the first plurality and spaced therefrom to create a corridor or walkway therebetween.

Figure 3:
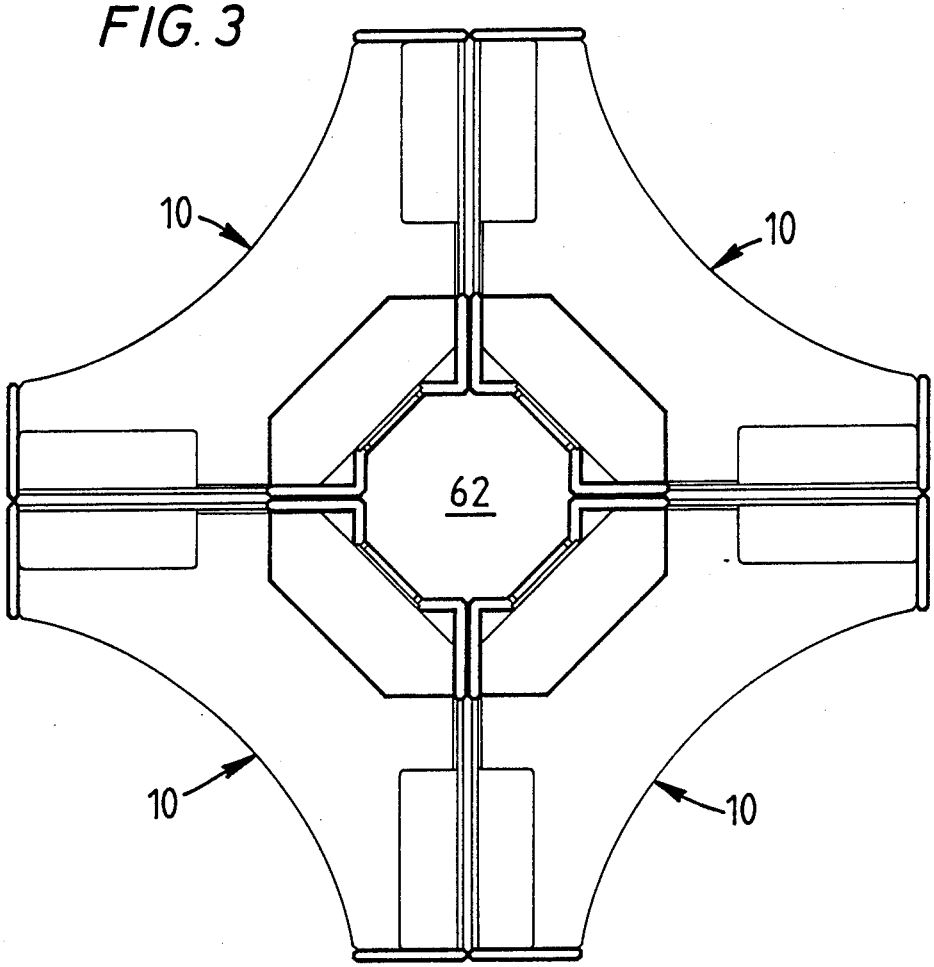
FIG. 3 four workstations arranged in a star configuration.

Referring to FIG. 3 there are shown four workstations 10 arranged in a star formation.

A useful feature of the design of the workstation 10 is the recess 60 formed by the external faces of the panels 30, 32 and 42 or 44. For example the open recess 60 can be used to accommodate a structural column often found in office buildings, or merely a decorative item such as a potted plant. The octagonal space 62 provided by the arrangement of four workstations can also be used to accommodate a column thus making the design of the layout of the office easier.

A workstation according to the invention can have one or more of the following novel features:

1. A worktop having a curved front working edge around two arms at right angles, allowing a clear uninterrupted work area free from intermediate legs or joins.

2. A combination of varying screen heights in one fixed piece of furniture.

3. A workstation having a shaped cut-out in the rear corner allowing it to be placed in various positions around and adjacent to obstructions such as structural columns. For example, four workstations when grouped together in a star configuration can combine to form an octagonal void in the centre by virtue of the recesses or cut-outs, so allowing this cluster to be located around a column.

This recess void area can provide other benefits of wire management and can accommodate lighting and power cables when the workstation is used in a cluster formation.

In the open plan the shaped recess or cut-out gives a novel appearance to the desks viewed from the rear when organised singly (i.e. on a corner) in pairs and in threes. When arranged in pairs, two of the backs "line up" to form a corridor and the two adjacent cut-outs join together to form a sculptured back with vertical emphasis and visual excitement.

4. The space under the panels 38, 40 is provided in order to allow a free flow of air under the workstation and is beneficial to the efficient functioning of office air conditioning systems.

5. The shape and location of the high level cupboard is unique. It is situated at such a height that a V.D.U. screen and drive unit can be accommodated under it and at the same time it provides a degree of shading to reduce reflection and glare on the V.D.U. screen. The shape is such that when four workstations are grouped together in a star configuration the cupboards group together to form an octagon.

When the workstations are clustered in groups and a number of groups are located together in a large open plan area the visual effect is of screens below eye level separating the working areas, with the octagonal high level cupboards rising above eye level. It is believed that no other workstation provides this combination in this manner.

6. Triangular voids at the rear of the worksurface can provide for:

access for fixing clamps for accessories passage for large wires, plugs and connectors etc.

air flow to ventilate equipment on the desk

The voids continue above the equipment behind the top cupboard.

7. The wire management is unique in the way in which the workstation provides for:

storage of excess cables including the tails from sockets to the actual items (lights, telephones, etc.)

coping with all currently known office equipment wiring systems providing simple flexibility in the provision of socket outlets at various locations above and below the workstation in any combination.

8. The design allows for the provision of shelves attached at one end of the inside face of panels 26, 28 either above and/or below the worktop and supported by a cantilever rod from panels 38, 40 at the other end.

9. The provision of shelves below the worktop.

10. The limited number and small area of the "legs" of the furniture on the floor allows a large number of floor panels to be lifted to give access to the floor voids.

I claim:

1. A workstation comprising:

a worksurface including a front edge, two lateral edges, two side edges and a rear edge, said lateral edges extending between respective first ends of said side edges and respective ends of said front edge, said front edge being curved with a constant radius along its entire extent;

lateral support members connected to said lateral edges of said worksurface and extending from a floor surface upwardly to at least said lateral edges of said worksurface and extending along said lateral edges between said respective first end of said side edges and said respective ends of said front edge; and rear support members connected to said side edges of said worksurface and extending from said floor surface upwardly to at least said side edges of said worksurface and extending along said side edges from points intermediate said respective lateral edges and said rear edge rearwardly to points beyond said rear edge, said rear support members being substantially L-shaped in horizontal cross-section such that they include first and second vertical walls, said first vertical walls extending along said side edges from points intermediate said respective lateral edges and said rear edge rearwardly to points beyond said rear edge, said second vertical walls extending from said points beyond said rear edge toward and into abutment with said rear edge of said worksurface, such that triangular voids are formed between said rear support members and said rear edge of said worksurface.

2. A workstation as recited in claim 1, wherein said lateral support members extend above said lateral edges of said worksurface and define lateral privacy screens.

3. A workstation as recited in claim 2, wherein said rear support members extend above said side edges of said worksurface and define rear privacy screens.

4. A workstation as recited in claim 3, further comprising a cupboard, spaced above a rear portion of said worksurface, connected to and being supported between upper portions of said rear support members.

5. A workstation as recited in claim 4, wherein said cupboard has a rear edge disposed substantially in a vertical plane defined by said rear edge of said worksurface, such that triangular voids formed between said rear edge of said worksurface and said rear support members, are formed between said rear edge of said cupboard and said rear support members.

6. A workstation as recited in claim 5, further comprising a rear panel removably attached along said rear edge of said cupboard between said rear support members.

7. A workstation as recited in claim 3, wherein a further privacy screen extends above said rear edge of said work surface between said rear support members.

8. A workstation as recited in claim 7, wherein side privacy screens are provided which extend above said worksurface and extend between respective ones of said lateral support members and respective ones of said rear support members.

9. A workstation as recited in claim 1, wherein the area defined beneath the entirety of said worksurface is free of support members.

10. A workstation comprising:

first and second mutually perpendicular vertically extending end panels spaced apart from one another and extending upwardly from a floor surface;

first and second mutually perpendicular vertically extending side panels spaced apart from one another;

a first side edge of said first end panel being connected to a first side edge of said first side panel such that said first side panel extends substantially perpendicularly from said first end panel;

a first side edge of said second end panel being connected to a first side edge of said second side panel such that said second side panel extends substantially perpendicularly from said second end panel;

said first and second side panels extending from said first and second end panels, respectively, inwardly toward one another;

a first vertical rear support extending upwardly from said floor surface and disposed adjacent a second side edge of said first side panel;

a second vertical rear support extending upwardly from said floor surface and disposed adjacent a second side of said second side panel; and a unitary worksurface extending between and being connected to said first and second end panels and first and second rear supports;

wherein said first and second rear supports have an L-shaped horizontal cross-section, and triangular voids are defined between said first and second rear supports and a rear edge of said worksurface.

11. A workstation as recited in claim 10, wherein said worksurface includes a front edge, free from connection with said first and second end panels and said first and second rear supports, which is curved along its entire extent between said first and second end panels.

* * * * *